US006540369B2

(12) United States Patent
Granite

(10) Patent No.: US 6,540,369 B2
(45) Date of Patent: Apr. 1, 2003

(54) ENGAGEMENT RING BRACELET

(76) Inventor: Victoria Granite, 9 Library Ct., Bayonne, NJ (US) 07002

( * ) Notice: Subject to any disclaimer, the term of this patent is extended or adjusted under 35 U.S.C. 154(b) by 0 days.

(21) Appl. No.: 09/909,565

(22) Filed: Jul. 20, 2001

(65) Prior Publication Data

US 2003/0016528 A1 Jan. 23, 2003

(51) Int. Cl.[7] ..... F21L 15/08
(52) U.S. Cl. ..... 362/104; 362/253; 362/806; 63/15; 63/7
(58) Field of Search ..... 362/104, 253, 362/806; 63/26, 29.1, 2, 6, 5.2, 7, 15, 1.13

(56) References Cited

U.S. PATENT DOCUMENTS 3,790,775 A * 2/1974 Rosenblatt ..... 362/104
3,804,307 A * 4/1974 Johnston ..... 362/104
3,805,548 A * 4/1974 Matwijcow ..... 362/104
4,473,969 A * 10/1984 Wilson ..... 446/464
4,942,744 A * 7/1990 Wei ..... 63/26
5,323,300 A * 6/1994 McCrary ..... 362/104
5,622,062 A * 4/1997 Gong-Hwa ..... 63/15
5,690,412 A * 11/1997 Sheldon ..... 362/104

* cited by examiner

*Primary Examiner*—Thomas M. Sember

(57) ABSTRACT

An engagement ring bracelet that includes a wrist band, a collet, a lid, a light, and a flasher. The collet extends upwardly from the wrist band and holds articles, and the lid selectively closes the collet. The light is disposed in the collet, and the flasher causes the light to blink. The lid is translucent and replicates a diamond so as to form a faceted lid. The blinking light and the translucent and faceted lid cause the lid to twinkle like a diamond.

13 Claims, 1 Drawing Sheet

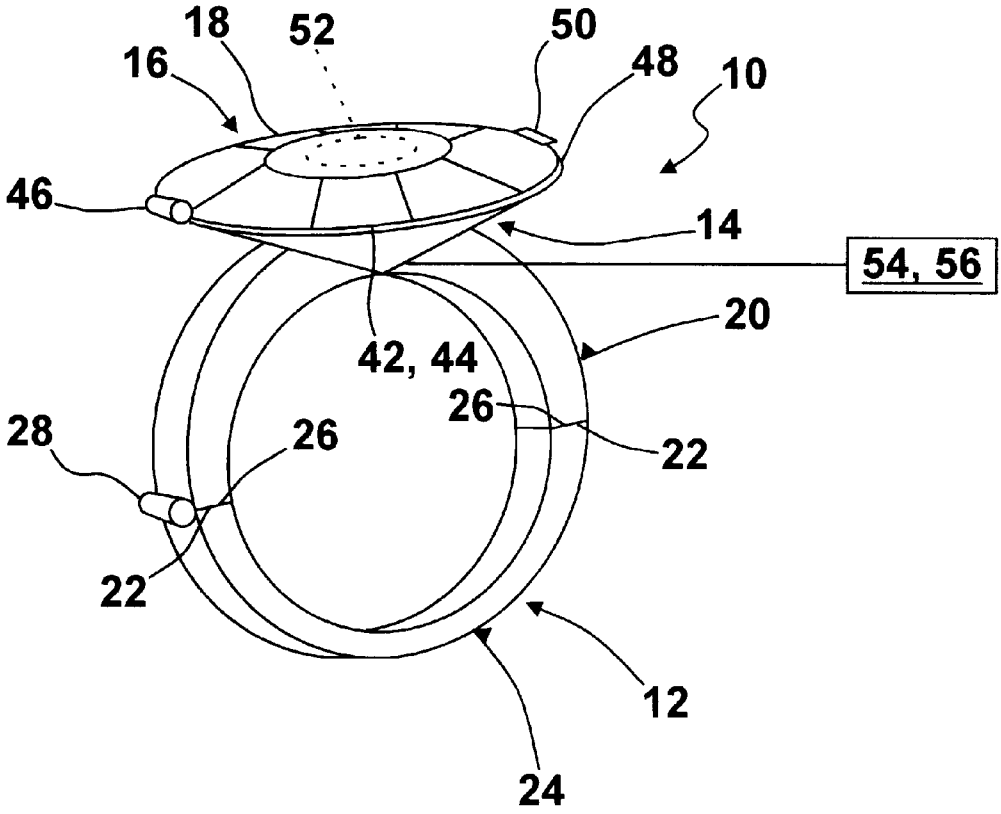
18
52
50
16
48
10
46
14
54, 56
20
42, 44
26
28
26
22
22
12
24

ENGAGEMENT RING BRACELET

BACKGROUND OF THE INVENTION

1. Field of the Invention

The present invention relates to a bracelet. More particularly, the present invention relates to an engagement ring bracelet.

2. Description of the Prior Art

Numerous innovations for bracelets have been provided in the prior art that will be described. Even though these innovations may be suitable for the specific individual purposes to which they address, however, they differ from the present invention.

FOR EXAMPLE, U.S. Pat. No. 4,473,969 to Wilson teaches a housing apparatus for a spring wound toy that includes a wrist band supported housing having a platform for supporting a spring wound toy, for example, a toy racing car, a cover hingedly mounted on the platform and resiliently urged to an open position, and a retractable ramp mounted on the housing. The lock member is a manually operated lock member, resiliently retained in a position to retain the cover in a closed position and upon being moved first releases the cover to permit it to move to an open position and then operates a toy release device to allow the toy to move off the platform. A cover slot, that in a cover closed position opens to the platform, is provided to have the toy winding stem extended therethrough and additionally to aid in restraining motion of the toy within the closure provided by the cover and platform.

It is apparent that numerous innovations for bracelets have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an engagement ring bracelet that avoids the disadvantages of the prior art.

ANOTHER OBJECT of the present invention is to provide an engagement ring bracelet that is simple to use.

BRIEFLY STATED, STILL ANOTHER OBJECT of the present invention is to provide an engagement ring bracelet that includes a wrist band, a collet, a lid, a light, and a flasher. The collet extends upwardly from the wrist band and holds articles, and the lid selectively closes the collet. The light is disposed in the collet, and the flasher causes the light to blink. The lid is translucent and replicates a diamond so as to form a faceted lid. The blinking light and the translucent and faceted lid cause the lid to twinkle like a diamond.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole FIGURE of the drawing is a diagrammatic perspective view of the present invention.

LIST OF REFERENCE NUMERALS UTILIZED IN THE DRAWING

10 engagement ring bracelet of present invention

12 wrist band

14 collet for holding articles (not shown)

16 lid

18 periphery of lid 16

20 first portion of wrist band 12

22 pair of terminal ends of first portion 20 of wrist band 12

24 second portion of wrist band 12

26 pair of terminal ends of second portion 24 of wrist band 12

28 spring hinge of wrist band 12 for facilitating donning, and once donned, biases wrist band 12 closed

42 top of collet 14 for allowing access to articles (not shown) therein

44 rim defining top 42 of collet 14

46 hinge

48 catch of rim 44 of collet 14

50 latch of periphery 18 of lid 16

52 light

54 battery interface for holding battery (not shown) for powering light 52

56 flasher

DETAILED DESCRIPTION OF THE PREFERRED EMBODIMENT

Referring now to the sole FIGURE, which is a diagrammatic perspective view of the present invention, the engagement ring bracelet of the present invention is shown generally at 10.

The engagement ring bracelet 10 comprises a wrist band 12, a collet 14 that extends upwardly from the wrist band 12 and is for holding articles (not shown), and a lid 16 that selectively closes the collet 14 and has a periphery 18.

The wrist band 12 has a first portion 20 that is semi-circular-shaped and has a pair of terminal ends 22, and a second portion 24 that is semi-circular-shaped, coplanarly attached to the first portion 20 of the wrist band 12, and has a pair of terminal ends 26.

One terminal end 22 of the first portion 20 of the wrist band 12 is free, one terminal end 26 of the second portion 24 of the wrist band 12 is free and abuts against the one terminal end 22 of the first portion 20 of the wrist band 12 when donned, and the other terminal end 26 of the second portion 24 of the wrist band 12 is attached to the other terminal end 22 the first portion 20 of the wrist band 12 by a spring hinge 28 that allows the wrist band 12 to be pivoted open for facilitating donning, and once donned, biases the wrist band 12 closed.

The collet 14 extends upwardly from the first portion 20 of the wrist band 12, is cup-shaped, and has a top 42 that is open for allowing access to the articles (not shown) therein and is defined by a rim 44 that is attached to the periphery 18 of the lid 16 by a hinge 46.

The rim 44 of the collet 14 has a catch 48, the periphery 18 of the lid 16 has a latch 50 that selectively engages the catch 48 of the collet 14, and when engaged therewith, the lid 16 is maintained closed. The catch 48 of the collet 14 and the latch 50 of the lid 16 are both disposed diametrically opposite to the hinge 46.

The engagement ring bracelet 10 further comprises a light 52 that is disposed in the collet 14, a battery interface 54 that is in electrical communication with the light 52 and is for holding a battery (not shown) for powering the light 52, and a flasher 56 that is in electrical communication with the light 52 and causes the light 52 to blink so as to form a blinking light.

The lid 16 replicates a diamond so as to form a faceted lid that is translucent so as to form a translucent lid that allows the light 52 to shine therethrough, and together with the blinking light 54, causes the lid 16 to twinkle like a diamond.

It will be understood that each of the elements described above, or two or more together, may also find a useful application in other types of constructions differing from the types described above.

While the invention has been illustrated and described as embodied in an engagement ring bracelet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An engagement ring bracelet, comprising:

a) a wrist band;

b) a collet; and c) a lid;

wherein said collet extends upwardly from said wrist band;

wherein said collet is for holding articles;

wherein said lid selectively closes said collet;

wherein said wrist band has a first portion;

wherein said wrist band has a second portion;

wherein said second portion of said wrist band is coplanarly attached to said first portion of said wrist band;

wherein said collet is cup-shaped;

wherein said collet has a top;

wherein said top of said collet is open for allowing access to the articles therein;

wherein said top of said collet is defined by a rim;

wherein said lid has a periphery; and wherein said periphery of said lid is attached to said rim of said collet by a hinge.

2. The bracelet as defined in claim 1, wherein said first portion of said wrist band is semi-circular-shaped; and wherein said first portion of said wrist band has a pair of terminal ends.

3. The bracelet as defined in claim 2, wherein said second portion of said wrist band is semi-circular-shaped; and wherein said second portion of said wrist band has a pair of terminal ends.

4. The bracelet as defined in claim 3, wherein one terminal end of said first portion of said wrist band is free;

wherein one terminal end of said second portion of said wrist band is free;

wherein said one terminal end of said first portion of said wrist band abuts against said one terminal end of said second portion of said wrist band when donned;

wherein the other terminal end of said second portion of said wrist band is attached to the other terminal end of said first portion of said wrist band by a spring hinge; and wherein said spring hinge allows said wrist band to be pivoted open for facilitating donning, and once donned, biases said wrist band closed.

5. The bracelet as defined in claim 1, wherein said collet extends upwardly from said first portion of said wrist band.

6. The bracelet as defined in claim 1, wherein said rim of said collet has a catch;

wherein said periphery of said lid has a latch; and wherein said latch of said lid selectively engages said catch of said collet, and when engaged therewith, said lid is maintained closed.

7. The bracelet as defined in claim 6, wherein said catch of said collet is disposed diametrically opposite to said hinge.

8. The bracelet as defined in claim 6, wherein said latch of said lid is disposed diametrically opposite to said hinge.

9. The bracelet as defined in claim 1, further comprising a light; and wherein said light is disposed in said collet.

10. The bracelet as defined in claim 9, further comprising a battery interface;

wherein said battery interface is for holding a battery for powering said light; and wherein said battery interface is in electrical communication with said light.

11. The bracelet as defined in claim 9, further comprising a flasher;

wherein said flasher is in electrical communication with said light; and wherein said flasher causes said light to blink so as to form a blinking light.

12. The bracelet as defined in claim 11, wherein said lid is translucent so as to form a translucent lid so as to allow said light to shine therethrough.

13. The bracelet as defined in claim 12, wherein said lid replicates a diamond so as to form a faceted lid;

wherein said blinking light, said translucent lid, and said faceted lid causes said lid to twinkle like a diamond.

* * * * *